US007439997B2

(12) United States Patent
Van Brocklin

(10) Patent No.: US 7,439,997 B2
(45) Date of Patent: Oct. 21, 2008

(54) SYSTEM AND METHOD FOR CONTROLLING A MULTI-FUNCTION DIGITAL MEDIA DRIVE

(75) Inventor: Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 436 days.

(21) Appl. No.: 11/237,911

(22) Filed: Sep. 29, 2005

(65) Prior Publication Data

US 2007/0070176 A1 Mar. 29, 2007

(51) Int. Cl.
*B41J 2/435* (2006.01)

(52) U.S. Cl. ..... 347/224

(58) Field of Classification Search ..... 369/195; 347/224–225

See application file for complete search history.

(56) References Cited

U.S. PATENT DOCUMENTS

| | | | | |
|---|---|---|---|---|
| 4,496,246 | A | 1/1985 | Ota et al. | |
| 5,105,418 | A * | 4/1992 | Kenmotsu et al. | 369/195 |
| 5,149,927 | A | 9/1992 | Stahly | |
| 6,853,042 | B2 | 2/2005 | Yoshida et al. | |
| 6,864,907 | B2 | 3/2005 | Bronson | |
| 2003/0108708 | A1 * | 6/2003 | Anderson et al. | 428/64.4 |

FOREIGN PATENT DOCUMENTS

JP 2005050409 A * 2/2005

OTHER PUBLICATIONS http://www.dvuser.co.uk/Main%20pages/news%20pages/jvc%20bluray.html (JVC Develops World's First Blu-Ray/DVD Combo, ROM Disc Tehnology, Jun. 21, 2005.

Miyauchi, N., et al., "Hologram Laser for CD-ROM Drive", Opto-electronic Devices Division, Electronic Components Group, Sharp Corporation (Japan).

http://www.disctronics.co.uk/technology/cdbasics/cd_specs.htm (CD Physical Specification), Jun. 21, 2005.

http://www.anandtech.com/storage/showdoc.html?i= 2010 (Anand Techn: AT News Update: DVD Dual Layer Primer).

http://harlie.gsfc.nasa.gov/HOES/HOEs.htm (Holographic Optical Elements), May 15, 2005.

* cited by examiner

*Primary Examiner*—Hai C Pham

(57) ABSTRACT

A multi-function digital media drive, has an optical pickup unit (OPU) configured to read data from or write data to a data layer of a digital medium, the OPU being associated with an OPU sled arrangement; an optical print head (OPH) configured to write to a labeling layer, the OPH being associated with an OPH sled arrangement, the OPU and the OPH being positioned on opposite sides of the digital medium; a motor; and a drive train configured to selectively supply motivating rotational energy from the motor to at least one of the OPU sled arrangement and the OPH sled arrangement.

23 Claims, 10 Drawing Sheets

SYSTEM AND METHOD FOR CONTROLLING A MULTI-FUNCTION DIGITAL MEDIA DRIVE

BACKGROUND OF THE INVENTION

Digital media, such as compact discs (CDs) or digital video discs (DVDs), are a popular form of storage media. Recently, writable digital media have become increasingly popular among users for storing personalized data, including creating their own set of musical compilations, pictures, videos etc. Once the user has stored or written digital data onto the medium, the user has applied a label medium by either writing on the medium by hand or affixing a printed label onto the medium using an adhesive.

More recently, systems have been developed for including a labeling layer on a digital medium using a laser of the disc drive. In such systems, laser energy is applied to activate the labeling layer to produce either a grayscale or a color image. In this regard, the optical pickup unit (OPU) that reads data from or writes data to a data layer of the digital medium may also be used for writing labeling data to the labeling layer.

However, such a media drive for writing data and labeling a medium typically requires the user to flip the medium over to label the medium after data has been written, for example. This tends to be inconvenient since the user must monitor the progress of the data write operation, and intervene after its completion by flipping the medium over before the labeling operation can begin. Furthermore, because the data writing and labeling operations are performed sequentially, a longer time is required to produce a written and labeled medium.

DETAILED DESCRIPTION OF CERTAIN EMBODIMENTS

Figure 1:
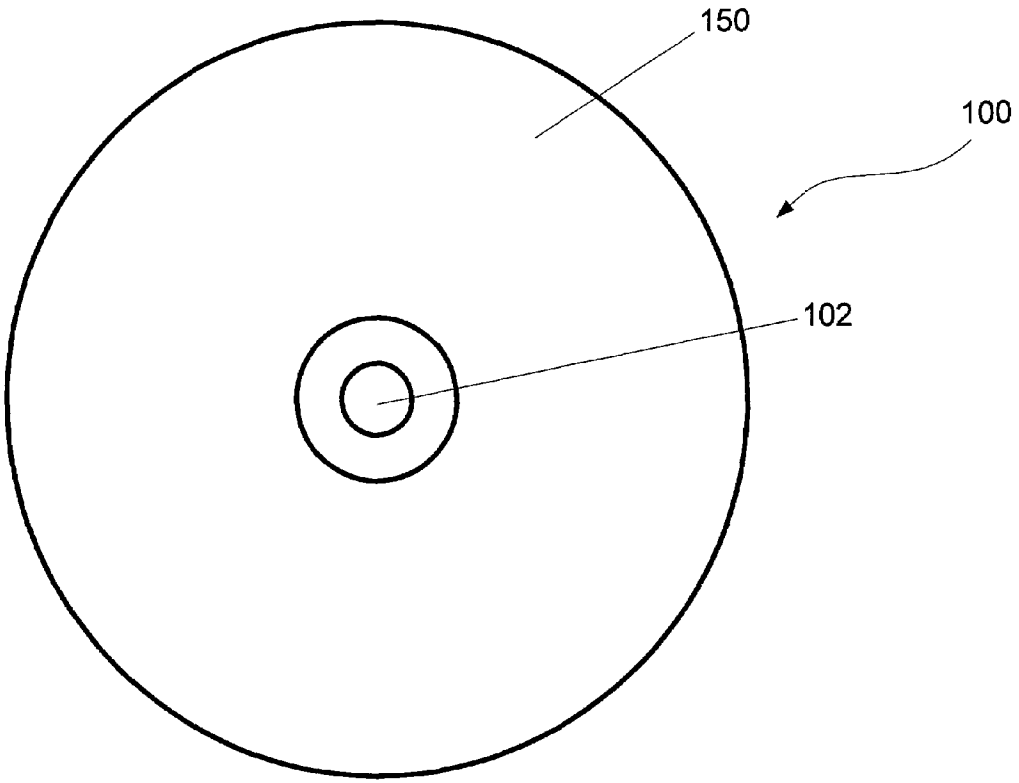
FIG. 1 is a top view of an embodiment of a digital medium.

Referring to FIG. 1, an exemplary digital medium is illustrated. The digital medium 100 may be an optical medium adapted to record and store digital information and is not limited to any particular type and may be a compact disc (CD), a digital video disc (DVD), a CD-ROM, CD-R, CD-RW or a DVD-ROM, DVD-R, DVD+R, DVD-RW, or a Blu-Ray drive for example. These arrangements can be either single of double layer arrangements and can use IR, red, or blue lasers, or a combination of these.

The digital medium 100 is provided with a central opening 102 for mounting the digital medium 100 onto a digital media drive, for example. The digital medium 100 includes a label layer 150 on one surface. This layer will be described in further detail hereinlater.

Figure 2:
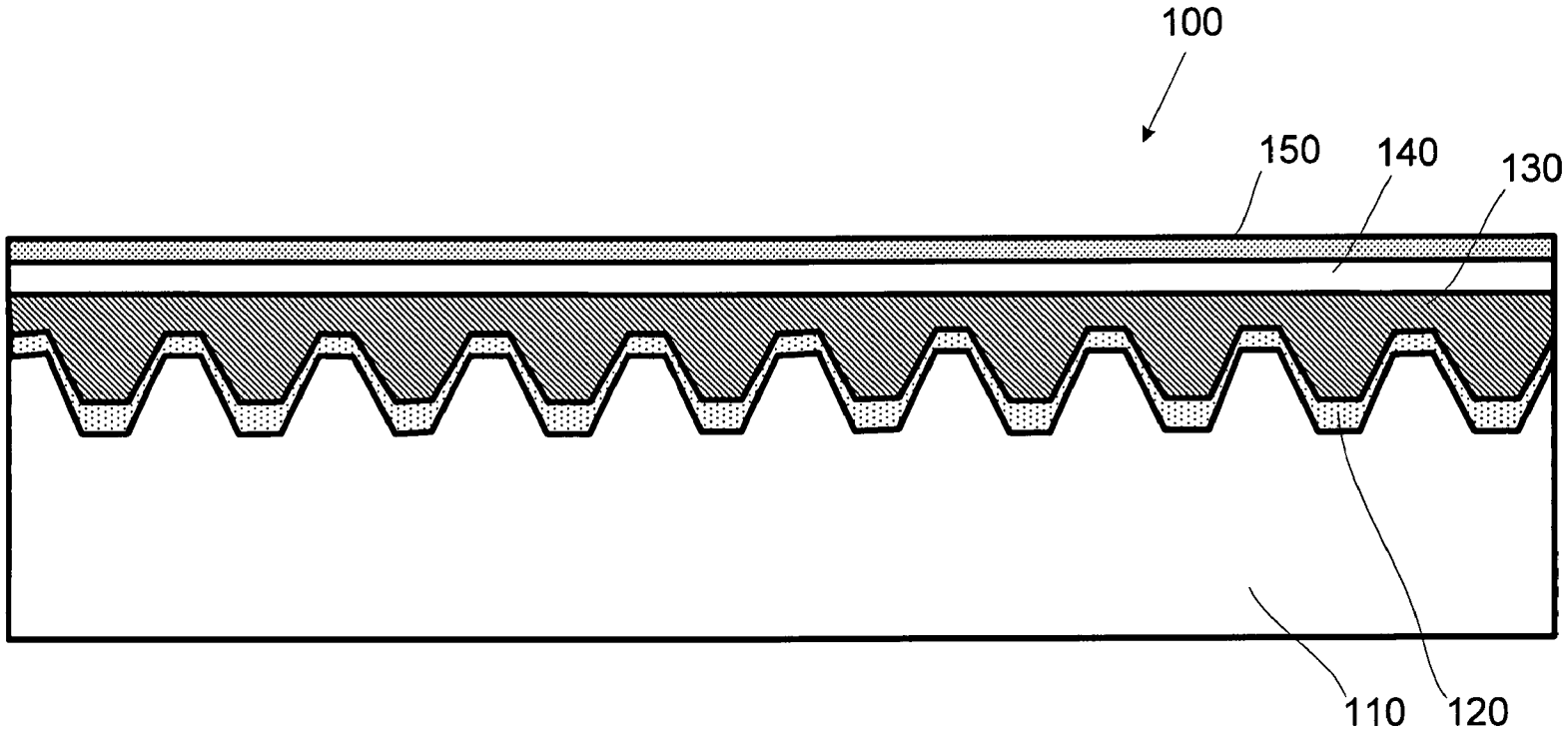
FIG. 2 is a cross-sectional view of the digital medium of FIG. 1.

Referring now to FIG. 2, a cross-sectional view of one embodiment of the digital medium of FIG. 1 is illustrated. The medium 100, in this example, includes a substrate layer 110, which in one embodiment may be 1.2 mm thick and may be made of a laser-transparent material such as polycarbonate, acrylate or glass, for example. A data recording layer 120 is provided on the substrate layer 110 upon which digital data may be written and stored, and which can subsequently be read.

In this embodiment, the data recording layer 120 includes or more grooved tracks formed on the substrate itself. The data can then be read from the data layer 120 using a laser. As is well understood by those skilled in the art, a laser beam impinges upon the substrate layer 110 (i.e. from the bottom of the medium as illustrated in FIG. 2) and generally penetrates through the substrate layer 110 to read from or write to the data layer 120.

A reflective or mirror layer 130 is formed over the data recording layer 120. Note that the reflective and the data layers are very thin, and as such they generally follow the contours of the groove. This reflective layer 130 may be, for example, an aluminum or gold reflective layer. A thin layer of clear lacquer 140, such as acrylic, is provided above the reflective and data layers for protection. The lacquer layer 140 may have a thickness of approximately four microns.

The configuration of layers 110, 120, 130, 140 are typical for CD-R type disc media. Of course, the present invention is not limited to this particular single layer type recording media as noted above, and multi layer arrangements such as found in DVD-DL (dual layer) wherein the first and second data recording layers are separated by a thickness of clear substrate, with the first data layer having a partially reflecting mirror layer. Semi-transparent metal reflecting layer and/or the data layer arrangements which are read using blue lasers as different from red and IR lasers, are fully within the purview of the invention. The digital data stored on different types of optical media (e.g. CDs, DVDs, Bluray discs, etc.) having different substrate thicknesses may be written or read using lasers of different wavelengths. For a CD, the substrate may be 1.2 mm thick and a 780 nm IR laser may be used. For a DVD, the substrate may be comprised of two 400 μm to 800 μm thick layers on either side of a data layer and a 650 nm red laser may be used. For a Blur-ay disc, the substrate may be 1.1 mm μm thick on the label side of the data layer and 100 um thick on the data side of the data layer and a 410 nm blue laser may be used. Regardless of the type of laser or the substrate thickness, however, the same issue with using the same laser and optics to write both the data layer (where the substrate causes spherical aberration) and the labeling layer (where there is little or no substrate and thus little or no spherical aberration) arises.

Commercially manufactured media containing predefined data, such as a movie or computer software, typically include a silkscreen type label on top of the lacquer layer 140, and thus labeling using the laser is not performed. However, blank discs, may include a thin labeling film (approximately 4-9 microns thick) of monochromatic, laser-sensitive material is positioned on top of the lacquer layer 140. In one example, a thin label layer 150 of laser-sensitive material is provided which may be made from a variety of materials. Note that the material used for the label layer 150 is not limiting on the invention. These labels are configured to be written to using direct disc labeling arrangements such as developed by Hewlett Packard® for example. One such suitable material is described in U.S. patent application publication 20030108708 by Anderson et al., "Integrated CD/DVC recording and labeling", which is assigned to the assignee of the present invention.

In some instances, the material forming the label layer 150 is of a neutral color prior to activation. The material is modified/activated by energy from a laser. The laser energy causes the activated film to change color and/or darkness, thereby producing an image. However, in some of the above-mentioned direct disc labeling arrangements, it is necessary to remove the disc from a data/read write orientation and reinsert the disc in an inverted or label writing position wherein the material can be directly exposed to the laser energy from the optical pickup unit or OPU used for data read/write operations, without passing through substrate 110. The optics associated with the OPU of the present invention are normally adapted to correct for the spherical aberration caused by the laser energy passing through the substrate 110. However, when the disc is flipped over for label writing, the laser energy is applied to layer 150 without passing through substrate 110, and so the correction which works well during the read/write mode now becomes a drawback. The embodiments of the invention which are discussed hereinafter are such as provide a solution to this problem.

Figure 3:
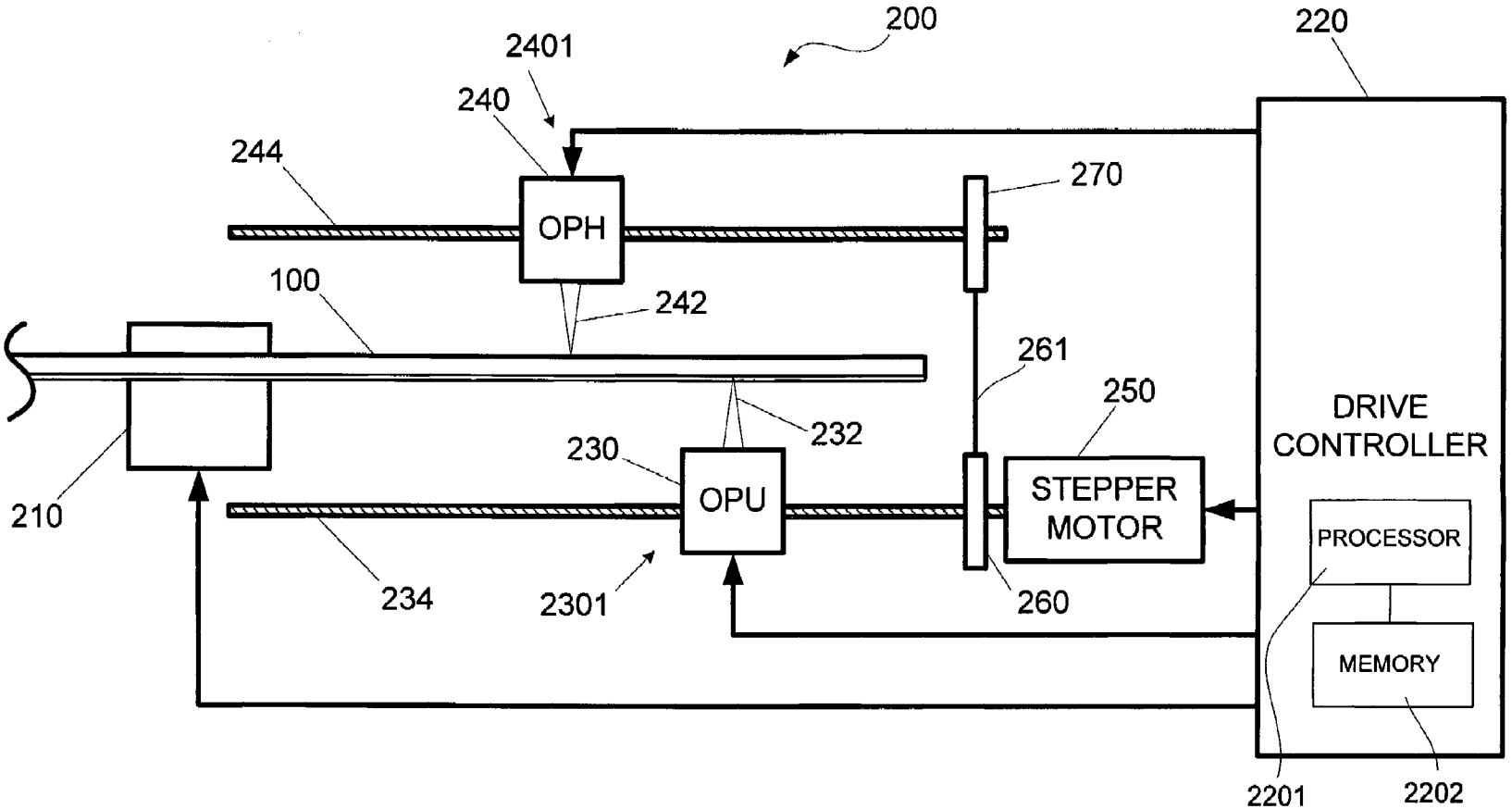
FIG. 3 is a schematic illustration of a first embodiment of a digital media drive according to the present invention.

FIG. 3 schematically illustrates a digital media drive which is equipped with an embodiment of the invention. In this embodiment, the illustrated digital media drive 200 includes a multi-sled, multi-function drive adapted to read/write data on a data layer of a digital medium and to write a label on a labeling layer of the digital medium. The digital media drive 200 includes a spindle 210 upon which a digital medium, such as the digital medium 100, may be mounted. The spindle may be driven by a motor (not shown) to spin the digital medium 100.

A drive controller 220 is provided to control the spindle 100 via the motor (not shown) according to instructions which may be received by the drive controller 220 from a processor, for example, of one or more associated computers. The drive controller 220 may be implemented as software, hardware, firmware, or a combination thereof. In one embodiment, the controller 220 includes a processor 2201 and a memory 2202. The memory 2202 may include instructions executable by the processor 2201.

The digital media drive 200 includes an optical pickup unit (OPU) 230 for writing data to or reading data from a data layer (such as data layer 120 of FIG. 3) of the digital medium 100. In this embodiment, an energy beam 232 is generated by a laser unit (not shown per se) of the OPU 230 and focused through a substrate layer (such as substrate layer 110 of FIG. 3) provided one side of the digital medium 100. The energy beam 232 and the associated laser unit may be adapted for the particular function of writing data to or reading data from the digital medium. The operation of the OPU 230, including the position and the energy beam, is controlled, at least in part, by signals from the drive controller 220. In one embodiment, the OPH may be an additional OPU.

The radial position of the OPU 230 is controlled by movement of the OPU 230 on an OPU sled system including a sled track 234, for example. The sled of the OPU 230 is driven along the sled track 230 by a driver, such as the stepper motor 250 of FIG. 3, which is adapted to receive signals from the drive controller 220. The stepper motor 250 may be provided with position feedback from the groove on the media, for example, for tracking of the position of the OPU sled.

On the opposite side of the digital medium 100 with respect to the OPU 230, an optical print head (OPH) 240 is provided to provide an energy beam 242 from an energy source (not shown per se) for writing a label onto a labeling layer (such as the labeling layer 150 of FIG. 2). The energy source and the energy beam 242 may be adapted for the specific purpose of writing labels on labeling layers. The operation of the OPH 240, including the position and the energy beam, is controlled, at least in part, by signals from the drive controller 220.

The OPH 240 is adapted to move in the radial direction on an OPH sled arrangement 2401 which includes an OPH sled track 244. The movement of the OPH on the OPH sled arrangement 2401 is effected by same stepper motor 250 as the OPU sled arrangement 2301. In this regard, the digital media drive 200 includes a coupling between the OPH sled arrangement 2401 and the OPU sled arrangement 2301. In this embodiment, the OPU sled arrangement 2301 is driven directly by the stepper motor 250 and the OPH sled arrangement 2401 is driven by a coupling with the OPU sled arrangement 2301. In an alternate embodiment (not shown), the OPH sled arrangement 2401 may be driven directly by the stepper motor 250 and the OPU sled arrangement 2301 driven by a coupling with the OPH sled arrangement In another embodiment, the coupling of the OPH sled arrangement to the OPU sled arrangement includes a drive gear arrangement 260 coupled to the OPU sled arrangement. Similarly, a driven gear 270 is coupled to the OPH sled arrangement. The driven gear 270 is adapted to be driven by the drive gear 260 via a drive belt 261 for example. The drive gear 260 may include a clutch to selectively engage or disengage the driven gear 270 and, thus, engage or disengage the OPH sled arrangement.

Figure 10:
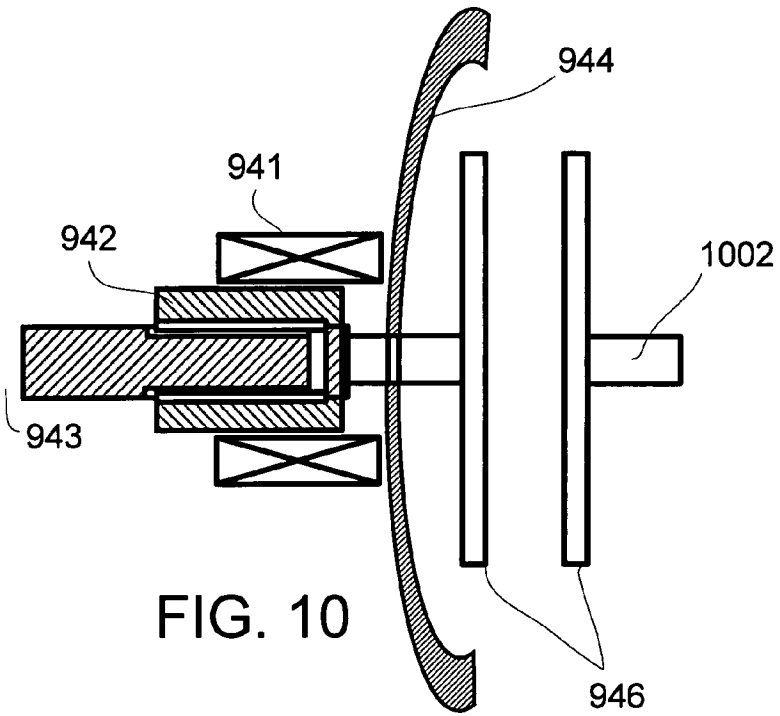
FIGS. 9 and 10 are schematic views showing an example of an electromagnetically operated clutch which has been induced to snap between engaged and open (released) positions, respectively, according to embodiments of the present invention.
Figure 9:
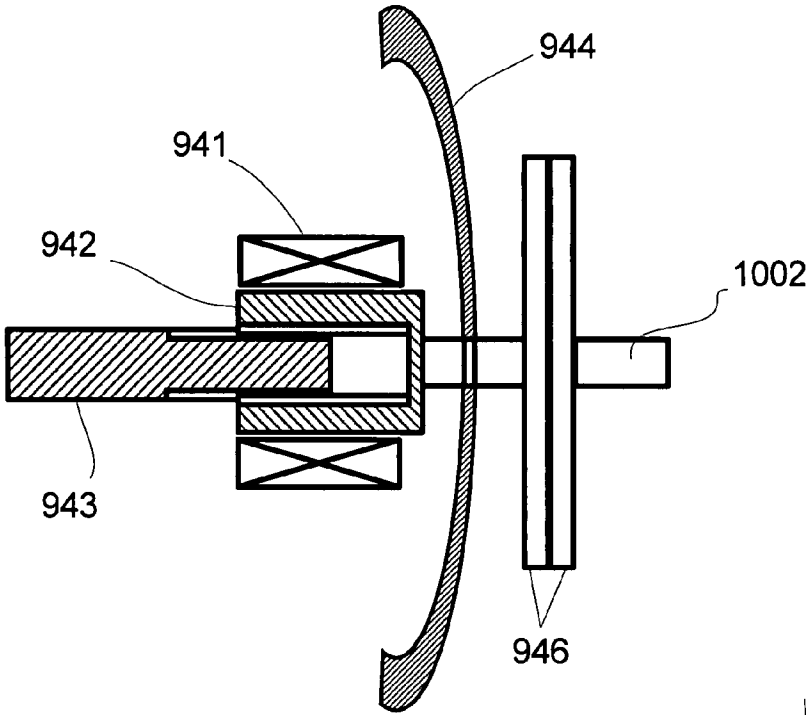

This clutch can be constructed in the manner schematically illustrated in FIGS. 9 and 10. In this arrangement a solenoid coil 941 is arranged to be energized in a manner to tract an armature 942, which is splined to an axially immovable output shaft 943, from a closed position to a open or released position, or vice versa. In this particular arrangement a Belleville type spring 944 is illustrated as being used to induce the armature 942 to snap from one position to the other as it passes over-center position of the spring 944. This type of arrangement obviates the need to maintain current flowing to the solenoid coil during either or both of the engaged and disengages states of the clutch. The Belleville spring 944 can be replaced by a suitable detent or detents if so desired. The faces of the clutch plates 946 can be configured to have teeth or suitable protrusions which interlock with one another and prevent slippage which may lead to inaccurate transfer of rotational energy to the OPH sled arrangement.

Thus, a single driver (e.g., the stepper motor 250) may be provided to drive both the OPU sled arrangement and the OPH sled arrangement.

Figure 4:
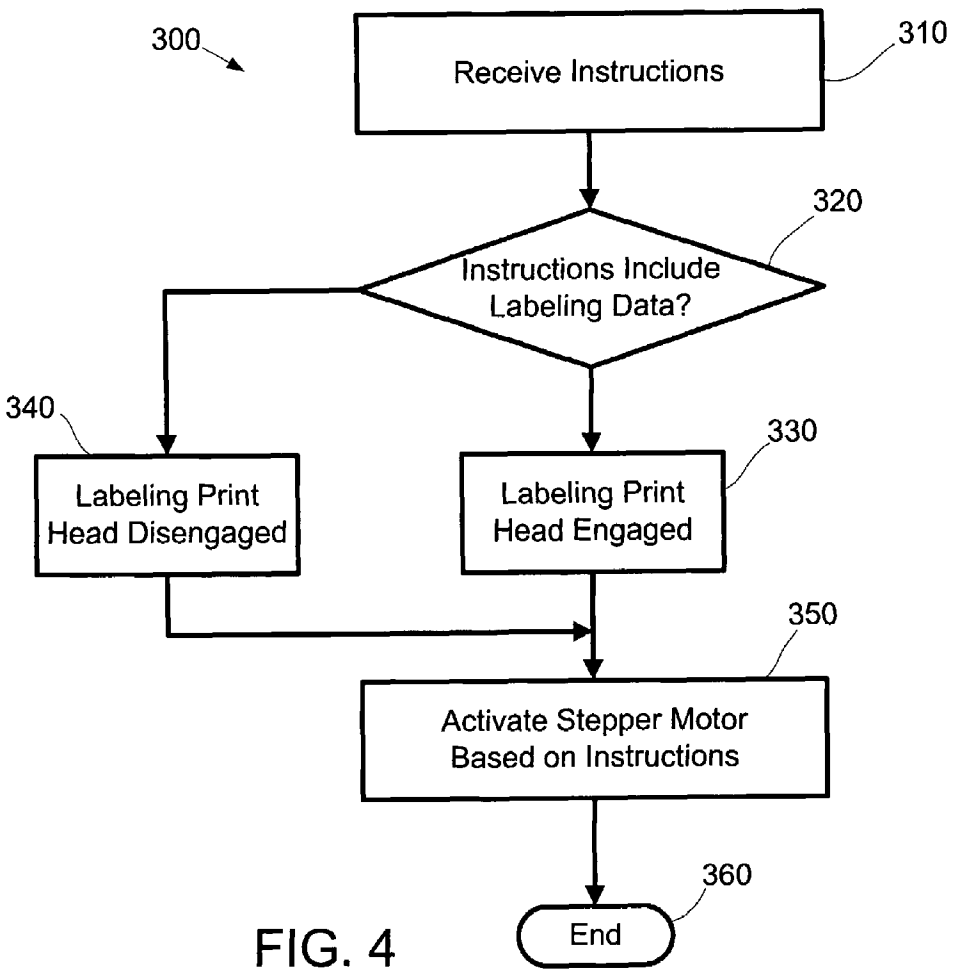
FIG. 4 is a flow chart illustrating an embodiment of a method of controlling the digital media drive depicted in FIG. 3 according to the present invention.

FIG. 4 illustrates an embodiment of a method of controlling a digital media drive such as the digital media drive 200 illustrated in FIG. 3. The method 300 begins with the receipt of instructions (step 310) indicating data to be read or written or a label to be written. In this regard, the instructions may be received from a processor, such as a CPU of a computer, by the drive controller 220 of FIG. 3, for example.

At step 320, the controller 220 determines whether the instructions include labeling data for writing a label onto the labeling layer. If the instructions do not include any labeling data, the method 300 proceeds to step 340, and the OPH sled arrangement is disengaged from the OPH sled arrangement, and the method 300 proceeds to step 350.

On the other hand, if the determination is made at step 320 that the instructions do include labeling data, the OPH sled arrangement is engaged. In this regard, a clutch may be provided within or in conjunction with the drive gear 260, for example, to selectively engage or disengage the OPH sled arrangement from the OPU sled arrangement. In certain embodiments, the clutch may have a default position, either engaged or disengaged. Thus, either step 340 or step 330 may be rendered unnecessary.

At step 350, the drive controller actuates the driver, such as the stepper motor 250 of FIG. 3, based on the writing instructions received. In this regard, the OPU sled arrangement may be driven to write or read any data from the data layer, and any labeling data may be used to write a label onto the labeling layer.

Figure 5:
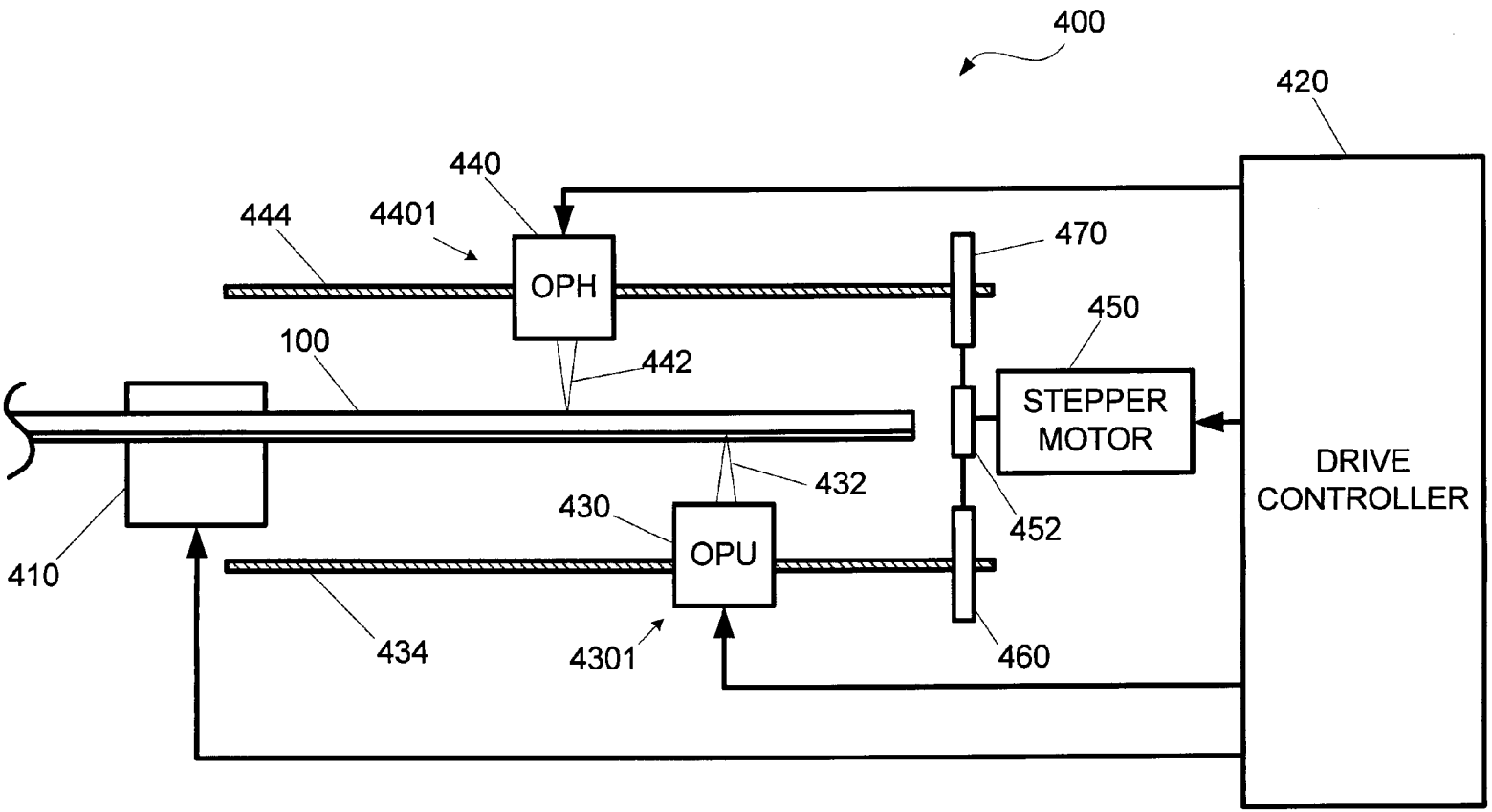
FIG. 5 is a schematic illustration of another embodiment of a digital media drive according to the present invention.

FIG. 5 illustrates another embodiment of a digital media drive 400. The illustrated digital media drive 400 is a multi-function drive and is similar to the digital media drive of FIG. 3. In the digital media drive 400 of FIG. 5, a stepper motor 450 is coupled to a central gear arrangement 452 which, in turn, is coupled to an OPU driven gear 460 and an OPH driven gear 470. The central gear arrangement 452 is provided with a clutch arrangement to selectively engage or disengage either the OPH sled arrangement or the OPU sled arrangement.

Thus, when only the OPU is required, the clutch arrangement provided in the central gear arrangement 452 may establish drive connection with the OPU sled arrangement, while disengaging the OPH sled arrangement. Similarly, when only the OPH is required, the clutch arrangement central gear arrangement 452 may engage the OPH sled arrangement, while disengaging the OPU sled arrangement. If both the OPU and the OPH are required, both sled arrangements may be engaged.

Figure 11:
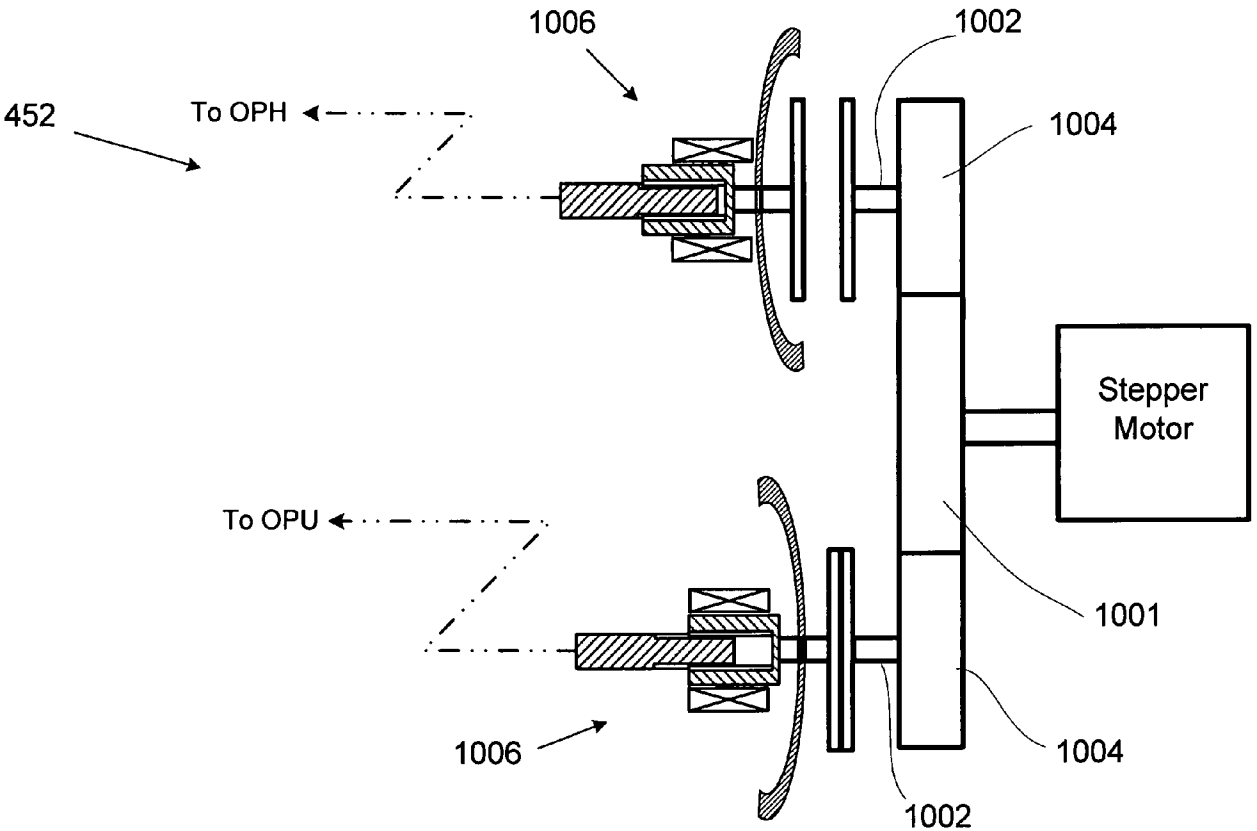
FIG. 11 is a schematic view showing the application of the type of clutch shown in FIGS. 9 and 10 in an embodiment of the invention.

This clutch arrangement, can be arranged, for example, in the manner schematically depicted in FIG. 11 and can comprise a central drive gear 1001. The shafts 1002 of clutch arrangements can be suitably arranged to be in drive connection with gears 1004 which mesh with the central drive gear 1001. Alternatively, a side face of the gears can be used as one of the clutch plates in each of the clutches 1006. A selected one or both of these clutches can therefore be engaged or disengaged as desired. The clutches can be used to establish drive connections with the OPU and OPH sleds as desired. In the illustrated arrangement, the OPU is being provided with drive from the stepper motor while the OPH is left disconnected. At any particular time, either none, one, or both of the clutches can be engaged.

Figure 6:
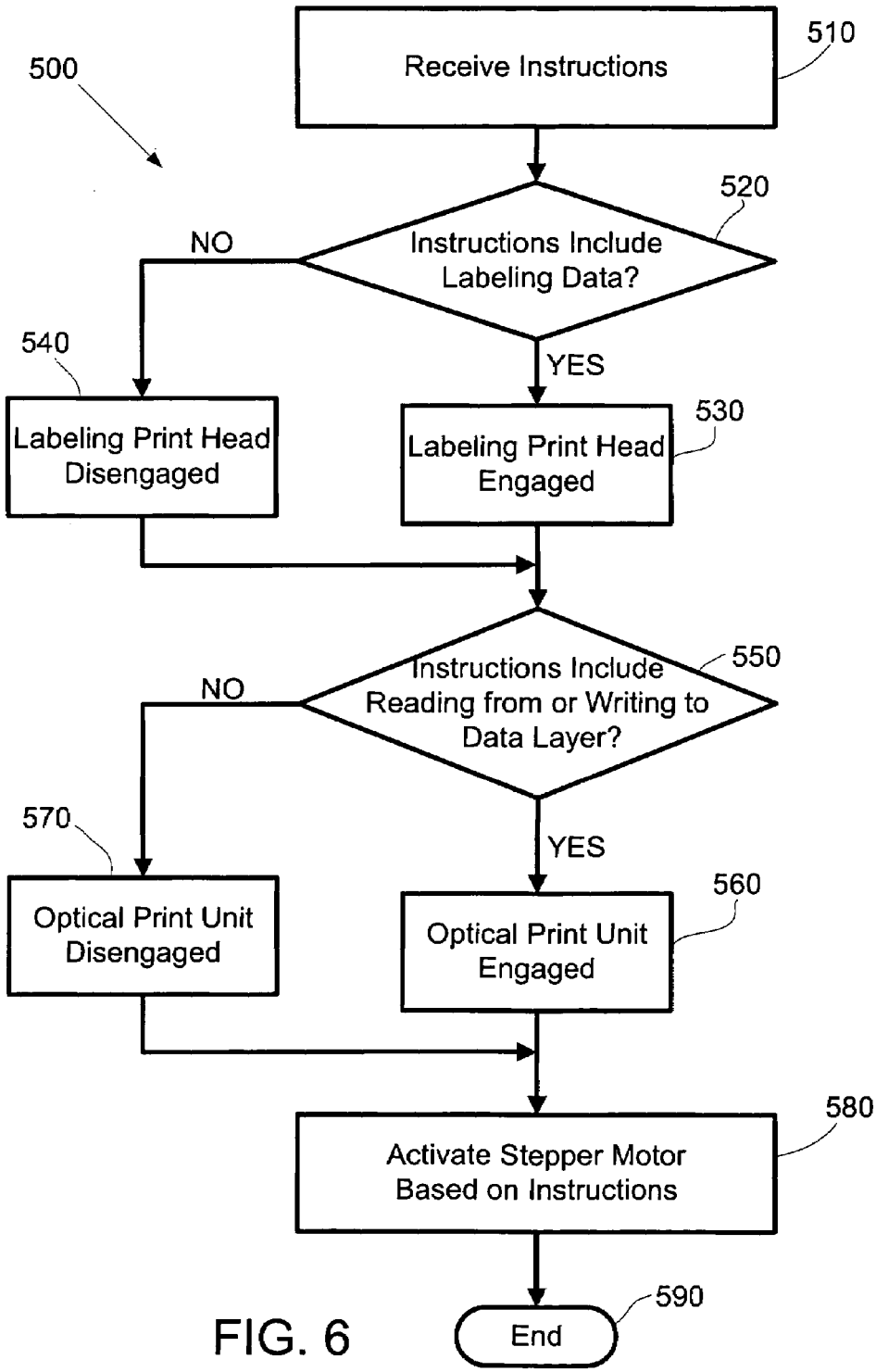
FIG. 6 is a flow chart illustrating an embodiment of a method of controlling the digital media drive of FIG. 5 according to the present invention.

FIG. 6 illustrates an embodiment of a method of controlling a digital media drive such as the digital media drive 400 illustrated in FIG. 5. The method 500 begins with the receipt of instructions (step 510) indicating data to be read or written or a label to be written. As described above with reference to FIG. 4, the instructions may be received from a processor, such as a CPU of a computer, by the drive controller 420 of FIG. 5, for example.

At step 520, the controller 420 determines whether the instructions include labeling data for writing a label onto the labeling layer. If the instructions do not include any labeling data, the method 500 proceeds to step 540, and the OPH sled arrangement is disengaged from the central gear arrangement 452 of FIG. 5, and the method 500 proceeds to step 550. On the other hand, if the determination is made at step 520 that the instructions do include labeling data, the drive between the OPH sled arrangement and the stepper motor 450, is engaged.

At step 550, the controller 420 determines whether the instructions include reading data from or writing data to the data layer, requiring operation of the OPU. If the instructions do not require operation of the OPU, the method 500 proceeds to step 570, and the OPU sled arrangement is disengaged from the central gear arrangement 452 of FIG. 5, and the method 500 proceeds to step 580. On the other hand, if the determination is made at step 550 that the OPU is required, the method proceeds to step 560, and the drive between the stepper motor 450 and the OPU sled arrangement is established.

At step 580, the drive controller actuates the driver, such as the stepper motor 450 of FIG. 5, based on the instructions received. In this regard, the OPU sled arrangement may be driven to facilitate the writing or reading of any data from the data layer, and any labeling data may be used to write a label onto the labeling layer. By appropriate arrangement of the instructions in one embodiment such that both labeling and data writing can be performed simultaneously, the time to produce a written and labeled medium can be advantageously reduced as compared to a drive in which the labeling and data writing operations are performed sequentially.

Figure 7:
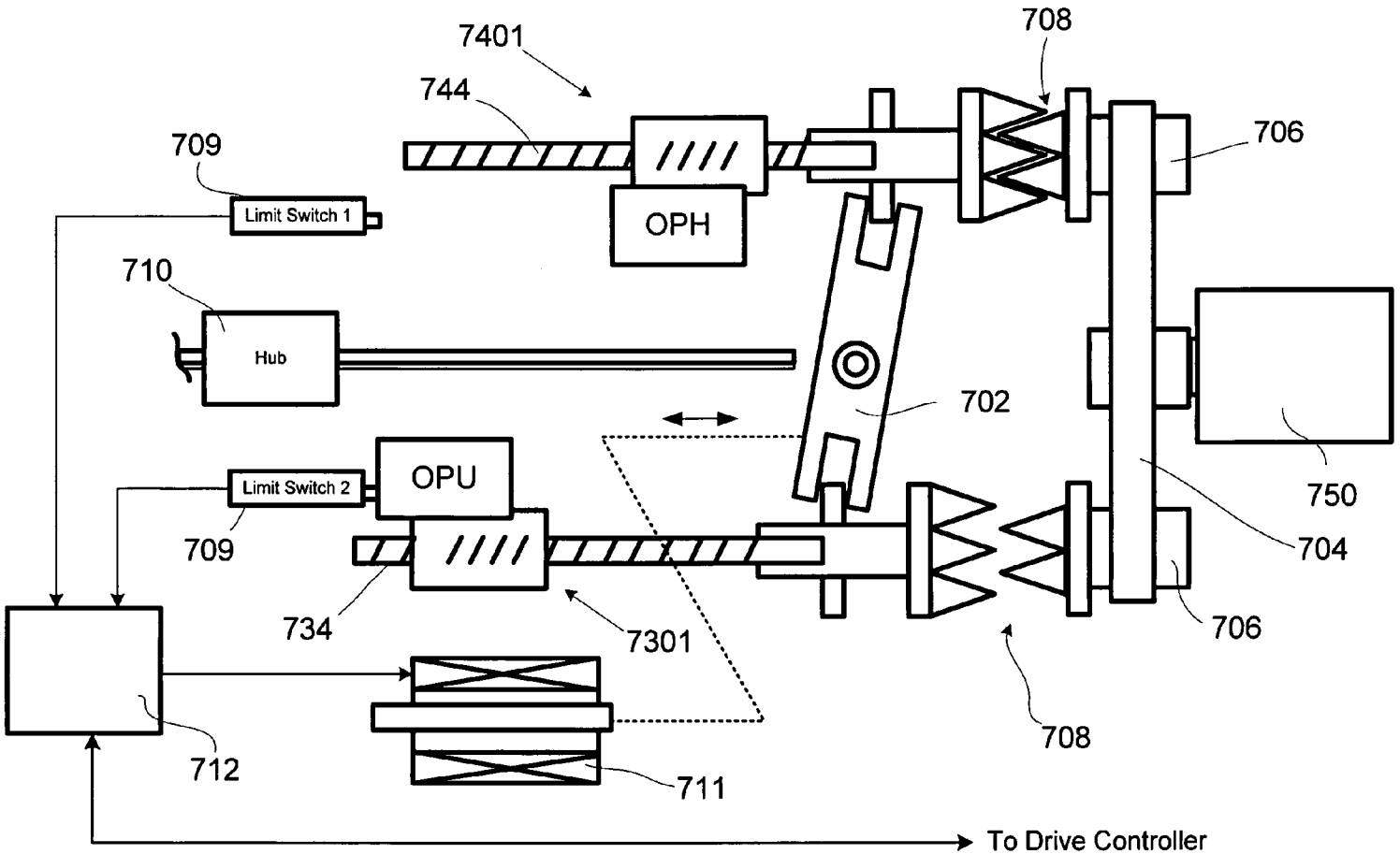
FIG. 7 is an illustration of an embodiment of the invention wherein a solenoid is used to implement switching drive connections.

FIG. 7 shows another embodiment wherein a mechanical toggle 702 is used to engage/disengage the clutches. The movement of the toggle 702 is arranged to be controlled by a solenoid 711 and the two operation clutches 708 are arranged to be independent of the position of the sleds. Limit switches 709 are used to determine the sleds having reached predetermined positions. The outputs of the limit switches 709 can be used to trigger solenoid energizations to induce the toggle to switch clutch engagements in accordance with the mode of operation that is desired. In one embodiment, only one of the clutches can be engaged at a particular time. In another embodiment, one of the clutches is engaged at all times.

Figure 8:
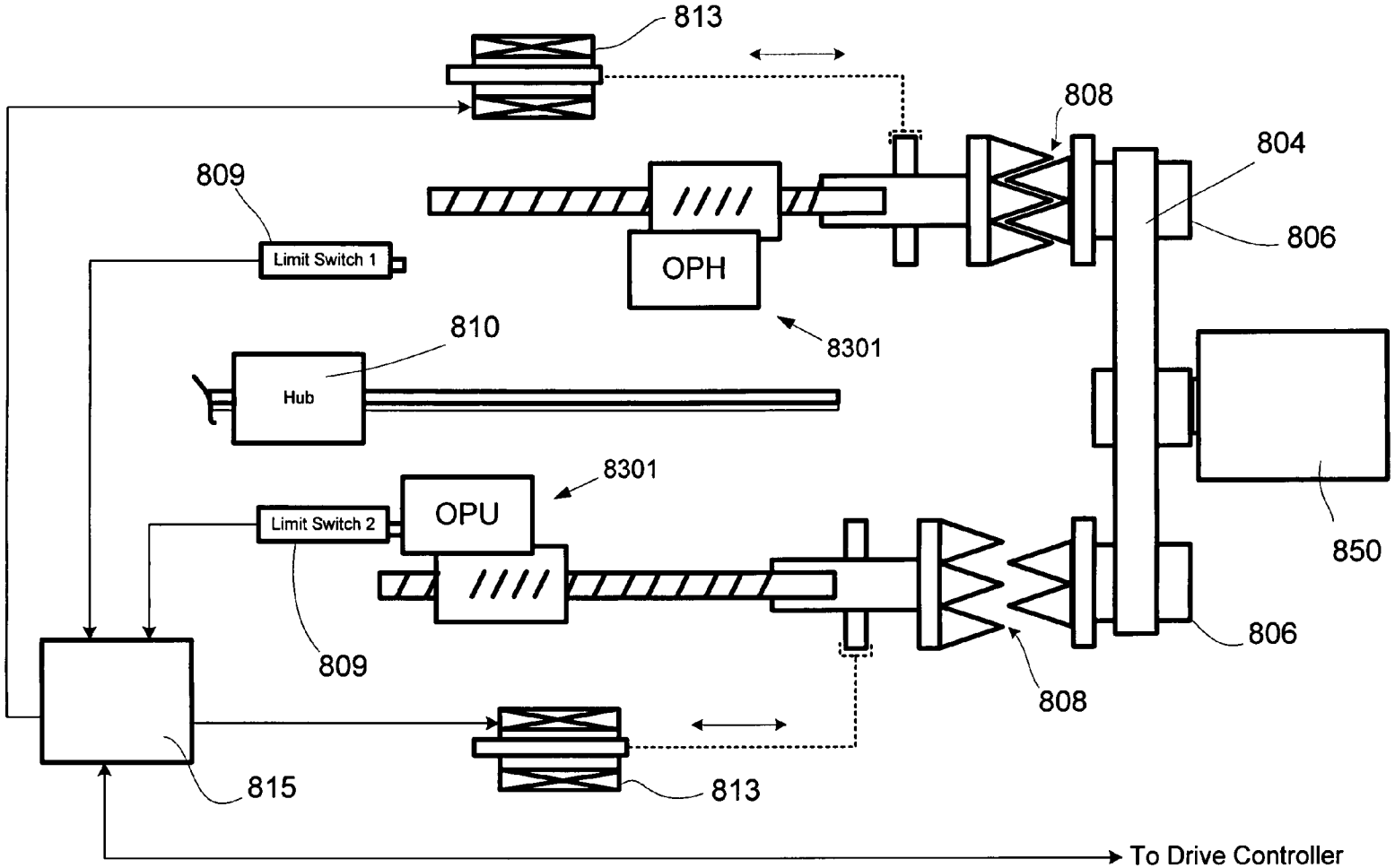
FIG. 8 is an illustration yet another embodiment of the invention wherein multiple solenoids are used to control the engagement of the clutch arrangements.

FIG. 8 shows a further embodiment of the invention. In this case, each of the clutches 808 is provided with its own solenoid 713 and thus enables one or both of the sleds to be driven at any selected time via outputs from a solenoid energization circuit 715.

A further embodiment of the invention resides in a program product for recording on an optical medium comprising: a computer readable medium having machine readable program code embodied therein to be executed by a computer, the machine readable program code comprising code for: receiving instructions indicative of at least one of digital data and labeling data; and if the instructions include labeling data, engaging a selectively engagable drive arrangement with a first sled arrangement, the first sled arrangement configured to position a first energy source in proximity to a location on one side of the optical disc at which visible marks corresponding to the labeling data are to be formed.

In addition to the above, this program product can have code for: if the instructions include digital data, engaging the drive arrangement with the second sled arrangement, the second sled arrangement configured to position a second energy source in proximity to a location on the other side of the optical disc at which the digital data is to be written.

Further, this program product can have code for: if the instructions do not contain digital data, disengaging the drive arrangement from the first sled arrangement, and if the instructions do not contain labeling data, disengaging the drive arrangement from the second sled arrangement.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiment was chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

What is claimed is:

1. A multi-function digital media drive, comprising:

an optical pickup unit (OPU) configured to read data from or write data to a data layer of a digital medium, the OPU being associated with an OPU sled arrangement;

an optical print head (OPH) configured to form visible marks on a labeling layer, the OPH being associated with an OPH sled arrangement, the OPU and the OPH being positioned on opposite sides of the digital medium;

a motor; and a drive train configured to selectively supply motivating rotational energy from the motor to at least one of the OPU sled arrangement and the OPH sled arrangement, wherein the drive train includes at least one clutch arrangement which enables the motor to be selectively coupled to the at least one of the OPU sled arrangement and the OPH sled arrangement, the clutch arrangement further comprising:

a solenoid;

an armature movable by application of energy to the solenoid;

an axially immovable output shaft splined to the armature;

a bistable mechanism coupled to the armature and positionable in one of the stable positions upon the application of energy to the solenoid.

2. The digital media drive according to claim 1, further comprising:

a controller adapted to selectively engage at least one of the OPU sled arrangement and the OPH sled arrangement with the motor.

3. The digital media drive according to claim 2, wherein the controller is adapted to engage the OPH sled arrangement with the motor when a label is to be written to the labeling layer of the digital medium.

4. The digital media drive according to claim 1, further comprising:

a controller adapted to simultaneously engage both the OPU sled arrangement and the OPH sled arrangement with the motor.

5. A method of controlling a multi-function digital media device, comprising:

providing a single motor;

selectively providing drive from the motor to at least one of an optical pickup unit (OPU) sled arrangement associated with a first energy source configured to apply energy to one side of a medium and an optical print head (OPH) sled arrangement associated with a second energy source configured to apply energy to an opposite side of the medium;

connecting one of the sled arrangements directly to the motor; and driving the other of the sled arrangements via a clutch which selectively connects the motor and the one of the sled arrangements.

6. The method of claim 5, wherein drive is simultaneously provided to both of the sled arrangements.

7. The method of claim 5, wherein the energy applied to the one side of the medium reads digital data from or writes digital data to the medium, and wherein the energy applied to the other side of the medium forms visible markings on the medium.

8. The method of claim 5, wherein drive is selective provided based on instructions received by the device, the instructions indicative of at least one of labeling data, write data, or data to be read.

9. The method of claim 8, wherein drive is provided to the OPU sled arrangement if the instructions are indicative of write data or data to be read, and wherein drive is provided to the OPH sled arrangement if the instructions are indicative of labeling data.

10. The method according to claim 5, further comprising:

connecting the OPU sled arrangement to the motor via an OPU sled clutch; and connecting the OPH sled arrangement to the motor via an OPH sled clutch.

11. A multi-function digital media drive, comprising:

an optical pickup unit (OPU) configured to read data from or write data to a data layer of a digital medium, the OPU being associated with an OPU sled arrangement;

an optical print head (OPH) configured to form visible marks on a labeling layer, the OPH being associated with an OPH sled arrangement, the OPU and the OPH being positioned on opposite sides of the digital medium;

a motor; and a drive train configured to selectively supply motivating rotational energy from the motor to at least one of the OPU sled arrangement and the OPH sled arrangement, wherein the drive train comprises a central gear which is in constant drive connection with the motor, the central gear arrangement being coupled to the OPU sled arrangement and the OPH sled arrangement though first and second clutch arrangements.

12. The digital media drive according to claim 11, wherein the first and second clutches are interconnected by a mechanical link that is configured to induce a change in an engagement status of the first clutch in response to a change in the engagement status of the second clutch and vice versa.

13. The digital media drive according to claim 11, further comprising:

a controller adapted to selectively engage at least one of the OPU sled arrangement and the OPH sled arrangement with the motor.

14. The digital media drive according to claim 11, further comprising:

a controller adapted to simultaneously engage both the OPU sled arrangement and the OPH sled arrangement with the motor.

15. The digital media drive according to claim 14, wherein the controller is adapted to engage the OPH sled arrangement with the motor when a label is to be written to the labeling layer of the digital medium.

16. A multi-function digital media drive, comprising:

an optical pickup unit (OPU) configured to read data from or write data to a data layer of a digital medium, the OPU being associated with an OPU sled arrangement;

an optical print head (OPH) configured to form visible marks on a labeling layer, the OPH being associated with an OPH sled arrangement, the OPU and the OPH being positioned on opposite sides of the digital medium;

a motor; and a drive train configured to selectively supply motivating rotational energy from the motor to at least one of the OPU sled arrangement and the OPH sled arrangement, wherein the drive train includes at least one clutch arrangement which enables the motor to be selectively coupled to the at least one of the OPU sled arrangement and the OPH sled arrangement, the clutch arrangement further comprising:

a solenoid;

an armature movable by application of energy to the solenoid;

an axially immovable output shaft splined to the armature;

a bistable mechanism coupled to the armature and positionable in one of the stable positions upon the application of energy to the solenoid;

a pair of selectively engageable clutch plates; and protrusions disposed on the clutch plates that are configured to interlock during engagement.

17. The digital media drive according to claim 16, further comprising:

a controller adapted to selectively engage at least one of the OPU sled arrangement and the OPH sled arrangement with the motor.

18. The digital media drive according to claim 16, further comprising:

a controller adapted to simultaneously engage both the OPU sled arrangement and the OPH sled arrangement with the motor.

19. The digital media drive according to claim 18, wherein the controller is adapted to engage the OPH sled arrangement with the motor when a label is to be written to the labeling layer of the digital medium.

20. A multi-function digital media drive, comprising:

an optical pickup unit (OPU) configured to read data from or write data to a data layer of a digital medium, the OPU being associated with an OPU sled arrangement;

an optical print head (OPH) configured to form visible marks on a labeling layer, the OPH being associated with an OPH sled arrangement, the OPU and the OPH being positioned on opposite sides of the digital medium;

a motor; and a drive train configured to selectively supply motivating rotational energy from the motor to at least one of the OPU sled arrangement and the OPH sled arrangement, wherein the drive train comprises:

a constant drive connection between one of the sled arrangements and the motor, and a clutch arrangement which enables the motor to be selectively coupled to the other of the sled arrangements.

21. The digital media drive according to claim 20, further comprising:

a controller adapted to selectively engage at least one of the OPU sled arrangement and the OPH sled arrangement with the motor.

22. The digital media drive according to claim 20, further comprising:

a controller adapted to simultaneously engage both the OPU sled arrangement and the OPH sled arrangement with the motor.

23. The digital media drive according to claim 22, wherein the controller is adapted to engage the OPH sled arrangement with the motor when a label is to be written to the labeling layer of the digital medium.

* * * * *